United States Patent [19]

Futamata et al.

[11] 3,996,840

[45] Dec. 14, 1976

[54] CONTROL CIRCUIT OF ACTUATOR

[75] Inventors: Masayuki Futamata, Tokyo; Hidenori Sato, Inagi, both of Japan

[73] Assignee: Kabushiki Kaisha Komatsu Seisakusho, Tokyo, Japan

[22] Filed: July 23, 1974

[21] Appl. No.: 491,112

[30] Foreign Application Priority Data

July 24, 1973 Japan ..... 48-82706

[52] U.S. Cl. ..... 91/457; 91/461; 137/596.15

[51] Int. Cl.[2] ..... F04B 21/00

[58] Field of Search ..... 91/461, 454, 457, 304; 251/43, 44; 137/505.18, 596.15

[56] References Cited

UNITED STATES PATENTS

| | | | |
|---|---|---|---|
| 1,114,431 | 10/1914 | Bopp | 251/43 X |
| 1,267,281 | 5/1918 | Schneider | 137/505.18 |
| 3,080,887 | 3/1963 | Brandenberg | 91/461 X |
| 3,103,230 | 9/1963 | Kutsche | 137/505.22 X |
| 3,104,861 | 9/1963 | Heyer et al. | 251/43 |
| 3,423,935 | 1/1969 | Budzich | 91/457 X |
| 3,433,131 | 3/1969 | Soyland et al. | 91/461 X |
| 3,517,681 | 6/1970 | Davison | 137/505.18 |
| 3,608,435 | 9/1971 | Conabee et al. | 91/461 X |
| 3,677,287 | 7/1972 | Morris | 251/43 X |
| 3,678,959 | 7/1972 | Liposky | 137/625.4 X |
| 3,693,506 | 9/1972 | McMillen et al. | 91/412 |

*Primary Examiner*—Carlton R. Croyle
*Assistant Examiner*—Edward Look
*Attorney, Agent, or Firm*—Armstrong, Nikaido & Wegner

[57] ABSTRACT

A control circuit for an actuator having an operation valve for selectively distributing hydraulic oil from a pump to plural actuators which has a plurality of conduits, a plurality of pilot-operated valves for controlling the flow direction of oil to the actuator side or the tank side, and a pilot spool valve, whereby the operating force of the operation valve can be greatly reduced in simple operation.

3 Claims, 2 Drawing Figures

CONTROL CIRCUIT OF ACTUATOR

BACKGROUND OF THE INVENTION

This invention relates to a hydraulic system for construction machinery, industrial vehicles, machine tools, etc. and more particularly to a control circuit for an actuator having an operation valve for selectively distributing hydraulic oil from a pump to plural actuators.

SUMMARY OF THE INVENTION

It is an object of the present invention to provide a control circuit for an actuator in a hydraulic system which reduces the operating force for an operation valve under the simple operation.

It is another object of the present invention to provide a control circuit for an actuator in a hydraulic system in which the operation of the actuator may be easily carried out by an operator.

BRIEF DESCRIPTION OF THE DRAWINGS

These and other objects, features and advantages of the control circuit of the actuator according to the present invention will become more fully apparent from the following description taken in conjunction with the accompanying drawings, in which.

DETAILED DESCRIPTION OF THE PREFERRED EMBODIMENT

Figure 1:
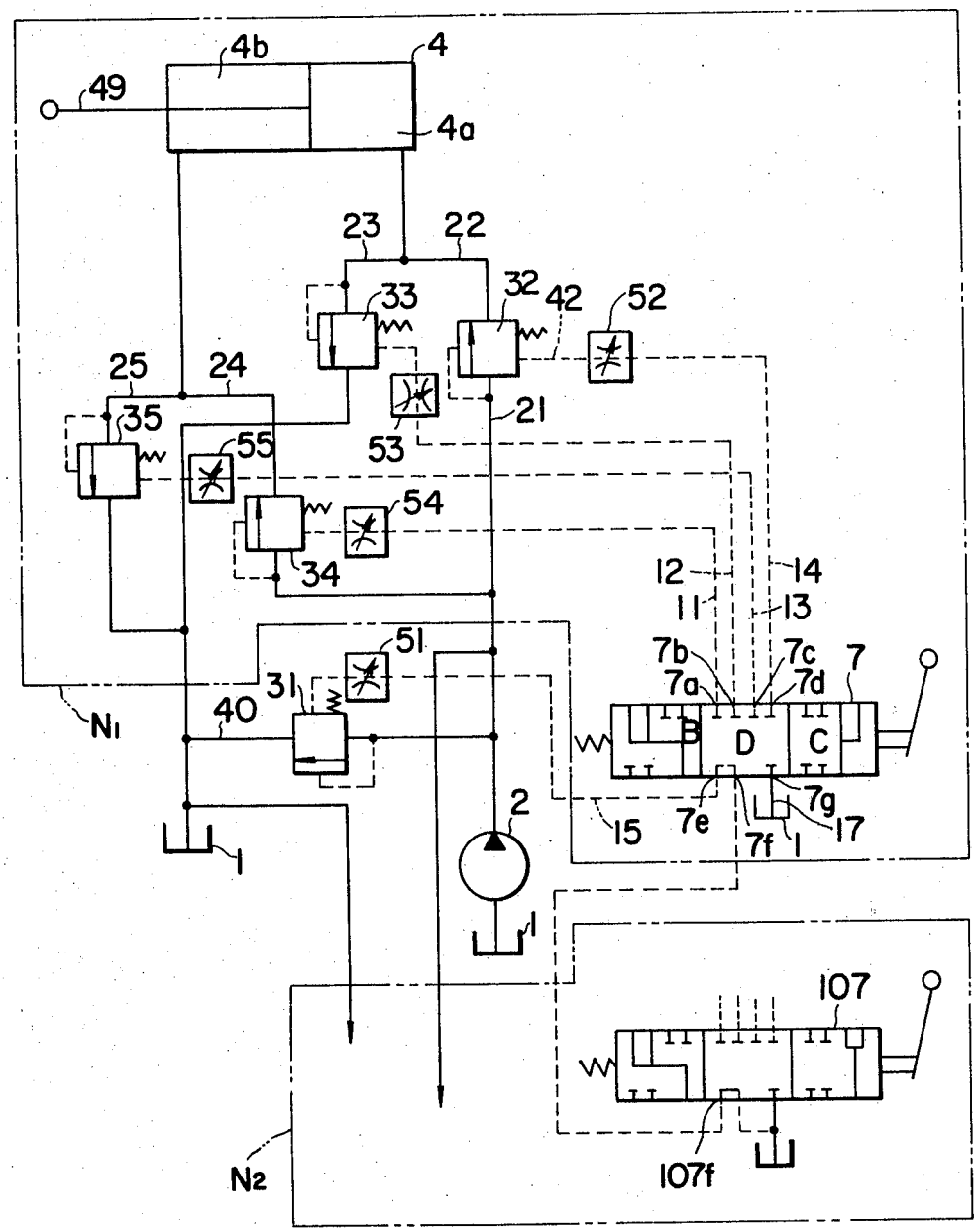
FIG. 1 is a hydraulic circuit of the control circuit of the actuators of the present invention.

Referring now to the drawings, which show one embodiment of the present invention, numeral 7 is a pilot spool valve, 4 an actuator, 2 a pump and, 1 a tank 31, 32, 33, 34 and 35 pilot-operated valves and, 51, 52, 53, 54 and 55 are flow control valves. The bottom side or second chamber 4*a* of the actuator 4 is connected to the discharge side of the pump 2 through a conduit 22, and the pilot-operated valve 32 is provided in the conduit 22. The bottom side 4*a* of the actuator 4 is connected to the tank 1 through a conduit 23, and the pilot-operated valve 33 is provided in the conduit 23. The rod side or first chamber 4*b* of the actuator 4 is connected to the tank 1 through a conduit 25, and the pilot-operated valve 35 is provided in the conduit 25. The rod side 4*b* of the actuator 4 is connected to the discharge side of the pump 2 through a conduit 24, and the pilot-operated valve 34 is provided in the conduit 24. The discharge side of the pump 2 is connected to the tank 1 through a conduit 40, at which the pilot-operated valve 31 is provided. The ports 7*a*, 7*b*, 7*c* and 7*d* of the pilot spool valve 7 are connected to the pilot-operated valves 34, 33, 35 and 32, respectively through pilot conduits 11, 12, 13 and 14, respectively, and flow control valves 54, 53, 55 and 52 are provided in the pilot conduits 11, 12, 13 and 14, respectively. The port 7*e* of the pilot spool valve 7 is connected through the pilot conduit 15 to the pilot-operated valve 31, and the flow control valve 51 is provided in the pilot conduit 15. The port 7*f* of the pilot spool valve 7 is connected to the port 107*f* of the pilot spool valve 107 of the second actuator circuit N2, and the port 7*g* is connected to the tank 1.

Figure 2:
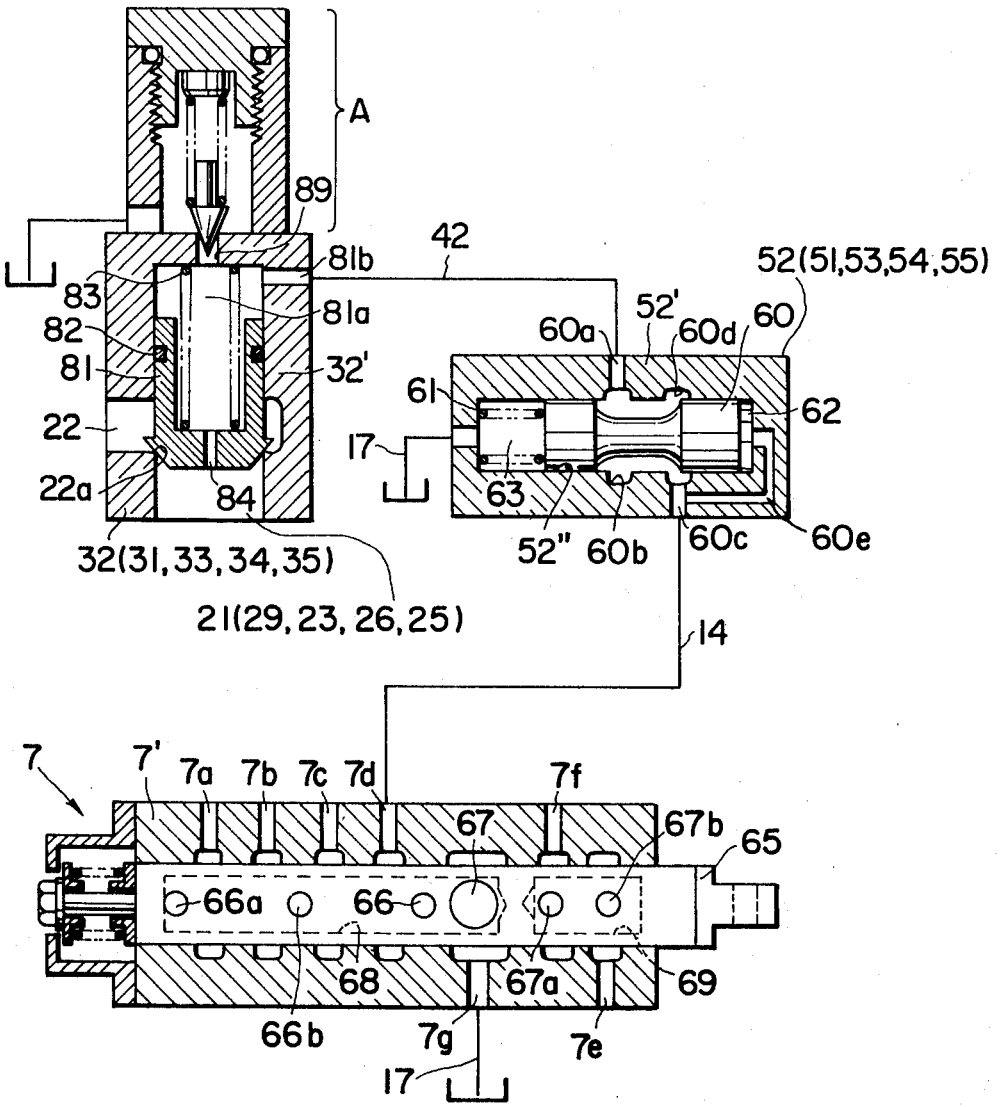
FIG. 2 is structural view of the elements used in the hydraulic control circuit of the present invention.

Reference is now made to FIG. 2, which shows the structure of the element used in the first actuator circuit $N_1$. Hollow chambers 68 and 69 are formed in the spool 65 of the pilot spool valve 7, and holes 66, 67 66*a* and 66*b* are formed in the spool 65 in communication with the hollow chamber 68 and holes 67*a* and 67*b* are formed in communication with the hollow chamber 69. The aforementioned ports 7*a*, 7*b*, 7*c*, 7*d*, 7*e*, 7*f* and 7*g* are provided in the valve body 7' of the pilot spool valve 7. The flow control valves 52, 51, 53, 54 and 55 have a spool 60 in the hole 52'' provided in the valve 52'. An annular groove 60*b* communicates with the port 60*a* is formed in the hole 52''. An annular groove 60*d* communicates with the port 60*c* is formed thereat, and the port 60*c* communicates with a back pressure chamber 62 through a hole 60*e* in such a manner that the spool 60 is urged toward the back pressure chamber 62 by a spring 61.

Further, the pilot-operated valves 32, 31, 33, 34 and 35 form a valve seat 22*a* within the valve body 32' at the intermediate portion of the conduit 22 in such a manner that a main spool 81 is held against the valve seat 22*a* by a spring 83. A port 81*b* is provided in the back pressure chamber 81*a* of the main spool 81, an orifice 84 is provided in the main spool 81, and a main valve pilot portion A is provided on the back pressure chamber 81*a* side of the main spool 81. The valve seat 22*a* for the main spool 81 has the same diameter as that of the back pressure chamber 81*a*, as shown in FIG. 2.

This pilot portion A is necessary to function as a relief valve for preventing higher pressure over a predetermined pressure to the respective pilot-operated valves 32, 31, 33, 34 and 35 from being produced, and it is not necessary to provide the pilot portion A, if it is not necessary to provide the function of a relief valve. In this case, the poppet seat hole 89 is closed.

When the spool of the pilot spool valve 7 is situated at the position B in FIG. 1, the ports 7*a* and 7*b* communicate with the drain port 7*g* so that the pilot-operated valves 34 and 33 communicate with each other through the conduits 24 and 23, with the result that, discharged oil from the pump 2 is introduced through the conduit 24 to the rod side 4*b* of the actuator 4 so that the oil in the bottom side 4*a* is introduced through the conduit 23 to the tank 1, accordingly the rod 49 is retracted. Then, when the spool of the pilot spool valve 7 is situated at the position C, both the ports 7*c* and 7*d* communicate with the drain port 7*g* so that the conduits 25 and 22 are brought into communication by the action of the pilot-operated valves 35 and 32, respectively, with the result that discharged oil from the pump 2 is introduced through the conduit 22 to the bottom side 4*a* of the actuator 4 so that the oil in the rod side 4*b* is introduced through the conduit 25 to the tank 1 so that the rod 49 is moved forward.

Then, the spool 65 of the pilot spool valve 7 is moved to the left in the drawing (FIG. 2) for the purpose of moving the rod 49 of the actuator 4 to the left by opening the operated valves 32 and 35 and by closing the pilot-operated valve 31 as an unload valve. Thus, the hole 66 communicates with the port 7*d*, part of oil in the conduit 21 is introduced through the orifice 84, conduit 42, flow control valve 52, conduit 14, port 7*d*, hole 66, hollow chamber 68, hole 67 to the port 7*g*. Therefore, a pressure difference is produced at the orifice 84 of the main valve 81 of the pilot-operated valve 32, and when this pressure difference reaches a predetermined value, the main valve 81 is moved against the spring 83.

In the flow control valve 52, when the spool 65 of the pilot spool valve 7 is moved leftwardly, the hole 66 partly communicates with the port 7*d*. When this hole 66 communicates with the port 7*d*, it forms a throttle to resist of hydraulic flow to the port 7*g* from the port 7*d*, and accordingly the resistance can be varied by moving the spool 65.

The spool 60 of the flow control valve 52 receives the hydraulic pressure from the conduit 14 in the back pressure chamber 62, to the contrary, receives the biassing force of the spring 61 and the hydraulic pressure from the conduit 17 in a chamber 63 formed within the valve 52. Therefore, the spool 60 is held in the position where the biassing force of the spring 61 is proportioned to a force on the differential pressure between the conduits 14 and 17 so that the spool 60 becomes stationary. Therefore, the spool 60 of the flow control valve 52 moves to the left and right in the drawing so that the differential pressure becomes substantially constant, with the result that, a volume of oil flowing into the conduit 14 from the conduit 42 becomes substantially constant.

The differential pressure generated between the conduits 14 and 17 is a function of the area occupied by a portion where the hole 66 opens into the port 7*d*, that is, the conduit 14 and the rate of flow of oil, and accordingly the fact that the differential pressure is constant means that the flow rate of pilot oil depends only on the displacement of the spool 65, that is, the open area of the hole 66 into the conduit 14.

Thus, the displacement of the spool 65 sets the lifting amount of the main valve 81 so that the flow rate in pilot is controlled, and accordingly the lifting amount of the main valve 81 is controlled so that the fine adjustment of the flow rate flowing into the conduit 22 from the conduit 21 can be easily controlled.

The above description has been directed to the pilot-operated valve 32, and since the principle of the operation of the other pilot-operated valves 33, 34, 35, 36 or 31 is similar, the description of thier operation has been omitted.

In FIG. 1, if the circuit similar to the circuit $N_1$ part is combined with the circuit $N_2$ part, a circuit for controlling the second actuator is formed. Similarly, it should be understood easily from the foregoing description that the third, fourth etc., actuators may also be formed similarly.

It should be understood from the foregoing description that since the control circuit of the actuator of the present invention comprises a conduit 24 enabling communication of the rod side 4*b* of the actuator 4 with the discharge side of a pump 2 therethrough; a conduit 25 enabling communication of the rod side 4*b* of said actuator 4 with a tank 1 therethrough, a conduit 22 enabling communication of the bottom side 4*a* of said actuator 4 with the discharge side of said pump 2 therethrough; a conduit 23 enabling communication of the bottom side 4*a* of said actuator 4 with said tank 1 therethrough; a first pilot-operated valve 34 provided in said conduit 24 for controlling the flowing direction of oil to the actuator side; a second pilot-operated valve 35 provided in said conduit 25 for controlling the flowing direction of oil to the tank side; a third pilot-operated valve 32 provided in said conduit 22 for controlling the flowing direction of oil to the actuator side; a fourth pilot-operated valve 33 provided in said conduit 23 for controlling the flowing direction of oil to the tank side; and a pilot spool valve 7 having a spool including a neutral position D, a position B for communicating only the ports 7*a* and 7*b*, which communicate with said pilot-operated valves 34 and 33, respectively, through a pilot conduit, with a drain port 7*g* and position C for communicating only the ports 7*c* and 7*d*, which communicate with the pilot-operated valves 35 and 32, respectively, through a pilot conduit with the drain port 7*g*; the operating labor for the actuator 4 can be drastically reduced because the actuator 4 may be operated by operating only the pilot spool valve 7 in which the respective pilot-operated valves are operated thereby, so that the manual operation thereto becomes remarkably simple. Further, since the pilot spool valve 7 has the smallest size, it may be disposed in the position where the operator can easily manipulate it and, thus the operation of the actuator becomes very easy.

What is claimed is:

1. A hydraulic control circuit for a hydraulic actuator comprising a cylinder and a piston, said cylinder having a first and second chamber separated by said piston, said circuit comprising:

a. a pump;
b. a tank;
c. first conduit means connecting said first chamber and said pump;
d. second conduit means connecting said first chamber and said tank;
e. third conduit means connecting said second chamber and said pump;
f. fourth conduit means connecting said second chamber and said tank;
g. first pilot operated valve means connected in said first conduit means for controlling the flow of hydraulic fluid between said pump and said first chamber;
h. second pilot operated valve means connected in said second conduit means for controlling the flow of hydraulic fluid between said first chamber and said tank;
i. third pilot operated valve means connected in said third conduit means for controlling the flow of hydraulic fluid between said pump and said second chamber;
j. fourth pilot operated valve means connected in said fourth conduit means for controlling the flow of hydraulic fluid between said second chamber and said tank;

wherein said first, second, third and fourth pilot operated valve means each comprise a valve body, a pressure chamber within said valve body, said pressure chamber having a valve seat therein, wherein the diameter of said valve seat is the same as the diameter of said pressure chamber, first spool means positioned in said pressure chamber, said first spool means having a valve seat thereon for engaging the valve seat in said pressure chamber, and biasing means for biasing said valve seats into engagement; and k. pilot valve means coupled to said first, second, third and fourth pilot operated valve means, said pilot valve means comprising a valve body having a plurality of ports therein, and second spool means within said valve body, wherein said plurality of ports in the body of said pilot valve means comprises a first port coupled to said first pilot operated valve means, a second port coupled to said second pilot operated valve means, a third port coupled to said third pilot operated valve means, a fourth port coupled to said fourth pilot operated valve means, and a fifth port coupled to said tank, and wherein said spool has at least one hollow chamber therein and a plurality of hole means for coupling predetermined ones of said ports to said hollow chamber, said second spool means having a first position for operating said first, second, third and fourth pilot operated valve means such that hydraulic fluid flows from said pump to said first chamber and from said second chamber to said tank, and when said actuator is moved in a first direction, and said second spool means has a second position for operating said first, second, third and fourth pilot operated valve means such that hydraulic fluid flows from said pump to said second chamber and from said first chamber to said tank, whereby said actuator is moved in a second direction opposite to said first direction.

2. The control circuit of claim 1, further comprising at least one other control circuit coupled to said first control circuit for operating a second actuator, wherein said at least one other control circuit is the same as said first control circuit, and wherein said pilot valve means includes a sixth port and said control circuits are coupled together through the respective sixth ports.

3. The control circuit of claim 1, further including first, second, third and fourth hydraulically operated flow control valves coupled between said pilot valve means and said first, second, third and fourth pilot operated valve means respectively, for regulating the flow of hydraulic fluid through said first, second, third and fourth pilot operated valve means respectively, wherein all of said flow control valves are coupled to said pilot valve means such that the pilot valve means controls the hydraulic operation of each of said flow control valves.

* * * * *